United States Patent [19]

McVey et al.

[11] 4,012,655

[45] Mar. 15, 1977

[54] REFRACTORY METAL OXIDE REFLECTOR COATING ON LAMP ENVELOPE

[75] Inventors: Charles I. McVey, Shaker Heights; O. Manuel Uy, Cleveland, both of Ohio

[73] Assignee: General Electric Company, Schenectady, N.Y.

[22] Filed: Aug. 4, 1975

[21] Appl. No.: 601,859

Related U.S. Application Data

[60] Continuation-in-part of Ser. No. 546,224, Feb. 3, 1975, which is a division of Ser. No. 404,178, Oct. 9, 1973, Pat. No. 3,879,625.

[52] U.S. Cl. ..... 313/27; 313/17; 313/113; 428/427

[51] Int. Cl.[2] ..... H01J 7/24

[58] Field of Search ..... 313/17, 27, 113, 221; 428/427

[56] References Cited

UNITED STATES PATENTS

| | | | |
|---|---|---|---|
| 3,226,249 | 12/1965 | Van Bakel et al. | 428/432 |
| 3,374,377 | 3/1968 | Cook | 313/17 |
| 3,533,827 | 10/1970 | Rimbach | 428/432 |
| 3,851,200 | 11/1974 | Thomasson | 313/113 |
| 3,879,625 | 4/1975 | McVey et al. | 313/27 |
| 3,889,142 | 6/1975 | Keeffe | 313/221 |

*Primary Examiner*—John Kominski

*Attorney, Agent, or Firm*—Ernest W. Legree; Lawrence R. Kempton; Frank L. Neuhauser

[57] ABSTRACT

The adherence of an optically reflective coating of refractory metal oxide particles such as $ZrO_2$ or $Al_2O_3$ on a fused silica discharge tube surface is improved severalfold by an adhesion layer consisting of colloidal aluminum oxide and boric oxide powders. The adhesion layer may be first applied and dried, the refractory metal oxide coating then applied, and the quartz tube then heated to a temperature greater than 460° C., the melting point of boric oxide. The refractory metal oxide particles may also be applied admixed with the colloidal aluminum oxide and the boric oxide. The improved coating strength permits the use of a thicker layer of refractory metal oxide for higher optical and thermal reflection.

10 Claims, 1 Drawing Figure

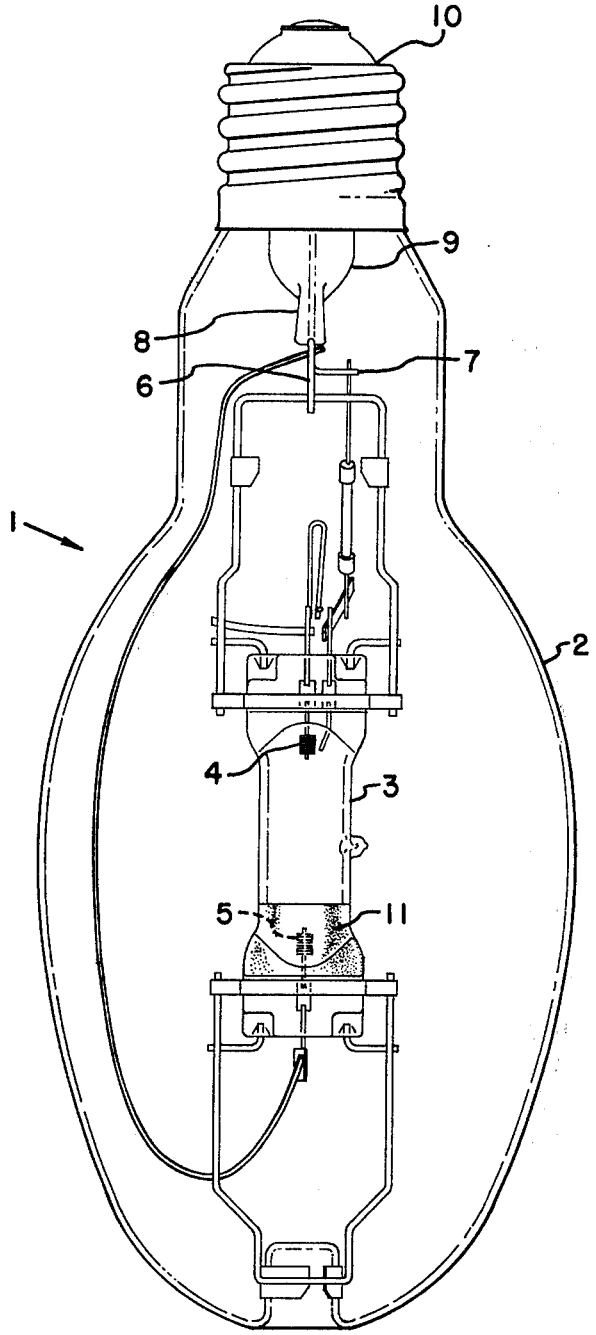
10
9
8
7
6
1
2
4
3
5
11

REFRACTORY METAL OXIDE REFLECTOR COATING ON LAMP ENVELOPE

BACKGROUND OF THE INVENTION

This is a continuation-in-part of application Ser. No. 546,224 filed Feb. 3, 1975 which is a division of application Ser. No. 404,178 filed Oct. 9, 1973, now U.S. Pat. No. 3,879,625 — McVey and Uy, issued Apr. 22, 1975.

The invention relates to heat and light-reflective coatings on fused silica lamp envelopes operating at high temperatures and is particularly concerned with improving the coating strength and adherence.

High intensity metal halide lamps such as disclosed in U.S. Pat. No. 3,234,421 — Reiling, are widely used for commercial, industrial, and outdoor lighting. In appearance these lamps resemble a conventional high pressure mercury vapor lamp comprising a quartz arc tube mounted within a glass outer jacket provided with a screw base at one end. Thermionic electrodes are mounted in the ends of the arc tube which contains a quantity of mercury and metal halides along with an inert gas for starting purposes. One commercially available lamp contains mercury, sodium iodide, thallium iodide and indium iodide, whereas another contains mercury, sodium iodide, scandium iodide and thorium iodide.

The portions of the arc chamber behind the electrodes, that is the ends of the arc tube, are the coolest regions in normal operation of such lamps. In the absence of special measures to raise the temperature of the ends, too much of the metal halide such as sodium iodide may remain condensed on the envelope wall behind the electrodes. To prevent this and cause the lamp to achieve its proper efficiency, heat and light reflective coatings are generally applied to the ends of the arc tube, sometimes to the lower end only in vertically operated lamps. A coating which has been widely used is described in U.S. Pat. No. 3,374,377 — Cook, "Metal Vapor Lamp Coating," issued Mar. 19, 1968 and consists essentially of zirconium oxide $ZrO_2$.

While a zirconium oxide coating has been quite satisfactory in respect of reflectivity and avoidance of darkening or release of deleterious gases into the interenvelope space, it is quite fragile and will not withstand abrasion. Bumping of lamps during handling and even the mere heating and cooling from intermittent operation may cause the coating to flake off. This contributes to nonuniformity in color from lamp to lamp and creates an appearance defect. Also the coating is limited in thickness, and thicker coatings having greater reflectivity are desirable. An aluminum oxide coating of equal reflectivity is even more fragile.

SUMMARY OF THE INVENTION

The object of the invention is to improve the adherence and coating strength of optically reflective coatings of zirconium oxide or aluminum oxide on a fused silica discharge tube. By fused silica it is intended to include quartz and quartz-like glasses, such as those comprising 96% silica and up, some of which are sold under the trademark Vycor.

In accordance with our invention, adherence of the refractory metal oxide coating is improved severalfold by an adhesion layer consisting of very fine aluminum oxide (colloidal) and boric oxide powders which are heated to a sufficient temperature, greater than 460° C., the melting point of boric oxide, to react the boric oxide chemically with the silica surface, the colloidal aluminum oxide, and the refractory metal oxide particles which may be $ZrO_2$ or $Al_2O_3$.

The adhesion layer may be applied as a distinct intermediate layer and the refractory metal oxide particles applied thereover, or the adhesion components and the refractory metal oxide particles may be mixed and applied together. For instance, the fused silica tube may be dipped into a suspension of the colloidal aluminum oxide and boric oxide powders and the coating allowed to dry. The coating of refractory metal oxide particles is then applied and may be applied alone or may first be admixed with colloidal aluminum oxide and boric oxide powders for even greater coating strength if desired. The silica tube is then heated to a temperature greater than 460° C. The mixed adhesion components and refractory metal oxide particles may also be applied directly without a precoat. The improved coating strength prevents flaking off and permits the use of a thicker layer of $ZrO_2$ or $Al_2O_3$ reflective particles for higher optical and thermal reflection than previously possible.

In the past zirconium oxide was preferred for the reflective coating on metal halide lamps because its higher index of refraction permitted a thinner layer to suffice than when aluminum oxide was used. This avoided the problem of lack of adequate adhesion and permitted a thinner layer to be used. Our invention has made possible the good adherence of either aluminum oxide or zirconium oxide by means of an adhesion coat. For many applications, aluminum oxide is now prepared because it provides adequate reflectivity and is lower in cost. Also alumina is available in much purer form than zirconia at a reasonable price, whereby it has less tendency to darken and a white coat throughout life is achieved.

DESCRIPTION OF DRAWING

The single FIGURE of the drawing is a side view of a metal halide lamp in which the arc tube is provided with an improved refractory metal oxide reflector coating embodying the invention.

DETAILED DESCRIPTION

The difficulty in achieving reliable adherence of $ZrO_2$ to fused silica arc tubes appears to be due at least in part to the mismatch in thermal expansion and the tremendous temperature range involved. The coefficient of thermal expansion of quartz is $0.56 \times 10^{-6}$ cm/cm/° C while that of $ZrO_2$ is $7.5 \times 10^{-6}$ cm/cm/° C, about 12 times greater. The arc tube wall temperature at the hottest coated spot, located slightly above the tip of the electrode, may be as high as 925° C. Thus in a lamp operating outdoors, the interface between the quartz and the $ZrO_2$ coating may pass through a temperature swing of close to 1000° C.

Aluminum oxide has a coefficient of thermal expansion of $8.0 \times 10^{-6}$ cm/cm/° C and is almost a perfect match for $ZrO_2$. The boric oxide $B_2O_3$ melts at 460° C and heating above that temperature permits reaction between $B_2O_3$ and $SiO_2$ and between $B_2O_3$ and colloidal $Al_2O_3$. We believe our invention thus provides an $Al_2O_3$ intermediate adhesion material firmly attached to the fused silica. At the interfaces between the colloidal $Al_2O_3$ and the $ZrO_2$ particles, the rates of thermal expansion substantially match, resulting in a much stronger bond. When $Al_2O_3$ particles are used in lieu of $ZrO_2$ the match is perfect. However the improved adherence and thicker coatings achieved by our invention are facts irrespectively of the validity of the foregoing explanation.

The adhesion layer according to the invention may conveniently be applied as a wet coating by dipping the quartz arc tube or envelope into a suspension of the aluminum oxide and boric oxide powders in an organic vehicle. Table I below lists representative formulations which were tested and studied to determine and optimize the permissible range with regard to $Al_2O_3$ to $B_2O_3$ ratio, the liquid to solid ratio and the ratio of high volatile to low volatile components in the organic liquid vehicle.

TABLE 1

| Formula | Methanol | Cellosolve | $Al_2O_3$ | $B_2O_3$ |
|---|---|---|---|---|
| 1 | 60 cc | 20 cc | 8.37 gm | 5.32 gm |
| 2 | 60 | 20 | 4.78 | 3.04 |
| 3 | 60 | 12 | 7.40 | 4.71 |
| 4 | 60 | 12 | 4.23 | 2.70 |
| 5 | 60 | 20 | 12.56 | 2.67 |
| 6 | 60 | 20 | 7.17 | 1.52 |
| 7 | 60 | 12 | 11.09 | 2.35 |
| 8 | 60 | 12 | 6.32 | 1.34 |
| 9 | 60 | 16.26 | 6.50 | 2.91 |

The $Al_2O_3$ used was very fine submicron size (colloidal) alumina such as is commerically available under the trademark "ALON C". The $B_2O_3$ used was in the hydrated form of boric acid $HBO_2$ and the weight given above is the $B_2O_3$ equivalent. Substantially all water present in the boric oxide and aluminum oxide is removed in subsequent heating of the quartz tube. For the highly volatile organic component, methanol of high purity (electronic grade) was used and for the nonvolatile component ethylene glycol monoethyl ether acetate commonly referred to as cellosolve acetate was used. The ingredients for each formulation were measured as indicated, placed in a one-third liter porcelain ball mill containing alumina pebbles, and intimately mixed by rolling for several hours.

The formulas were tested on the quartz arc tubes of metal halide lamps of conventional construction as illustrated in the drawing. The lamp 1 comprises an outer glass envelope 2 containing a quartz arc tube 3. The arc tube contains electrodes 4,5 set in opposite ends and has sealed therein a filling comprising mercury, sodium iodide, thallium iodide, indium iodide, and an inert starting gas such as argon. The electrodes are connected to inleads 6,7 sealed through press 8 of stem 9 of outer envelope 2. The inleads are connected externally to the contact surfaces of screw base 10 attached to the neck end of the envelope.

The illustrated lamp is intended for base-up operation and the reflective coating 11 has been applied to the lower end of the arc tube only. In a lamp intended for base-down operation, the coating would be applied to the opposite end of the arc tube. The outer envelope 2 may be evacuated as a heat conservation measure, or it may be filled with an inactive gas. The illustrated lamp corresponds to a 400-watt size wherein the outer envelope is generally evacuated; in larger sizes an inactive gas, generally nitrogen, is provided in the interenvelope space.

A zirconium oxide suspension suitable for spraying was prepared by milling 870 grams of zirconium oxide in 870 cc of ethyl cellulose binder with 12 cc of surfactant for several hours until the average particle diameter measured 0.8 to 0.85 micron. The ethyl cellulose binder consisting of 2.9% solids by weight is made by the following formula:

ethyl cellulose — 29 grams
di butyl phthalate — 44 grams
xylol (xylene) — 914 grams
butanol (butyl alcohol) — 13 grams The foregoing ingredients are rolled in a glass jug until the ethyl cellulose goes into solution.

The formulations in Table 1 were tested by dipping the end of the arc tube into a suspension of the adhesion mix and allowing to air dry. The arc tube was then wrapped with suitable masking paper exposing the portion 11 desired to be coated. The arc tube is heated to about 180° C and clamped in a fixture which rotated slowly before a spray gun. The previously prepared zirconium oxide suspension is sprayed during several revolutions of the arc tube. The arc tube is then taken from the fixture, the masking paper is removed, and excess material is brushed off. The arc tube is then baked in air for about 10 minutes at 600° C.

Coating strength and adherence of the zirconium oxide coating were than measured following the scratch-adhesion test designation F32–68 of the American Society for Testing and Materials. In this test a needle is drawn across the coated area in a manner forming two intersecting scratches. The test specimen is then blown with compressed air to dislodge any loosened coating and microscopically examined to appraise the degree of coating removal. In Table 2 below, "coating strength" is the weight in grams that must be applied to the needle or stylus to cut through the coating with only superficial scratching of the underlying base; "adherence" is inversely proportional to the extent of chipping and raggedness at the intersection of the scratches, and is measured on a scale from 0 to 4 by comparison with observational standards.

TABLE 2

| Test Variables | Coating Strength (grams) | Adherence (Scale of 0 to 4) |
|---|---|---|
| Zirconia without adhesion mix | 25 | 2.0 |
| Zirconia with adhesion mix | 70 | 4.0 |

Table 2 shows the results using formula 8 of Table 1 which is that preferred. The coating strength using the adhesion mix according to the invention has risen from 25 to 70, and the adherence has moved up from 2 to 4.

The quantity of $B_2O_3$ applied in the intermediate adhesion layer should be from 0.05 to 0.5 mg/cm$^2$ and the quantity of $Al_2O_3$ from 0.5 to 1.5 mg/cm$^2$. A preferred formulation is about 0.1 mg. of $B_2O_3$ and 0.3 mg. of $Al_2O_3$ per cm$^2$.

The intermediate adhesion layer according to the invention achieves a threefold increase in coating strength and makes practical the application of thicker $ZrO_2$ reflector coats which are desirable in metal halide lamps for greater color uniformity. Prior to the invention, $ZrO_2$ coatings heavier than 5 mg/cm$^2$ has insufficient adherence and would flake off. With the invention, coating weights from 5 up to 30 mg/cm$^2$ will adhere, and a preferred coating weight is now about 15 mg/cm$^2$.

An example of a reflective coating utilizing aluminum oxide is as follows. The precoat may be applied in the same fashion as previously described. Thereafter the reflective metal oxide layer may be applied by spraying or alternatively by dipping. Since a thicker layer is desirable when $Al_2O_3$ particles are used, they are first admixed with colloidal $Al_2O_3$ and $B_2O_3$ for better adhesion. An experimental formulation successfully used for dipping with a suitable binder such as that earlier described is as follows:

270 grams $Al_2O_3$ particles (average particle size 0.5 micron)

5.0 gram colloidal alumina (Alon-C — 0.01 to 0.02 microns)

2.0 grams $H_3BO_3$ — boric acid

The composition is milled three hours in a 1.0 liter alumina ball mill with alumina stones. The material is applied by dip coating dried and lehred above 460° C to react the materials.

Coating the refractory metal oxide particles in this way, that is by first precoating the fused silica surface with the colloidal alumina and boric oxide and thereafter overcoating with the refractory metal oxide particles admixed again with colloidal alumina and boric oxide achieves maximum adhesion. In such case the colloidal aluminum oxide and the boric oxide are present both in a layer intermediate the silica surface and the refractory metal oxide particles, and also dispersed between the refractory metal oxide particles. The method is particularly suitable for applying aluminum oxide coatings which need to be somewhat thicker in order to achieve the same reflectivity as zirconium oxide coatings. The aluminum oxide coatings are lower in cost and are more stable and resistant to darkening over the life of the lamp.

The reflective coating of refractory metal oxide particles may also be applied admixed with colloidal alumina and boric oxide to a surface which has not been precoated with colloidal alumina and boric oxide. Good adherence may be achieved in this way at reduced cost. The colloidal aluminum oxide and boric oxide is then dispersed between the refractory metal oxide particles. We have found this method to be particularly suitable for applying a reflective coating to alumina ceramic, for instance to the end of a polycrystalline alumina ceramic tube such as is used in high pressure sodium vapor lamps.

With alumina ceramic arc tubes the mismatch between alumina ceramic and zirconia is not nearly so great and bonding between the surfaces is not as important as bonding of the reflective particles to each other for greater impact resistance. The coating may be applied using either alumina or zirconia particles admixed with colloidal alumina and boric oxide in a formulation such as previously described, and excellent interoxide particle bonding is achieved upon heating above 460° C. The bonding can be demonstrated by peeling the coating after reaction with a razor sharp knife. The coating can be sliced into small cut peels. The coating is somewhat fragile due to its low density and is readily removable from the alumina tube surface. Coatings without the boric oxide were attempted and the interparticle bonding was so weak that peeling was not possible; the coating simply crumbled into dust. Particles of aluminum oxide can be made to adhere to alumina ceramic in the same fashion as zirconium oxide.

What we claim as new and desire to secure by Letters Patent of the United States is:

1. A fused silica envelope having an optically reflective coating of $Al_2O_3$ particles adherent thereto by means of an adhesion layer consisting of colloidal aluminum oxide and boric oxide heat-reacted with the silica surface, said $Al_2O_3$ particles being heat-reacted with said adhesion layer.

2. A fused silica envelope as in claim 1 wherein the colloidal aluminum oxide and boric oxide are present primarily in a layer intermediate the silica surface and the $Al_2O_3$ particles.

3. A fused silica envelope as in claim 1 wherein the colloidal aluminum oxide and boric oxide are dispersed between the $Al_2O_3$ particles.

4. A fused silica envelope as in claim 1 wherein the colloidal aluminum oxide and boric oxide are present in a layer intermediate the silica surface and the $Al_2O_3$ particles, and also are dispersed between the particles.

5. A fused silica envelope as in claim 1 wherein the weight of $B_2O_3$ in said adhesion layer is from 0.05 to 0.5 $mg/cm^2$ and the weight of colloidal $Al_2O_3$ is from 0.05 to 1.5 $mg/cm^2$.

6. A fused silica envelope as in claim 2 wherein the weight of $Al_2O_3$ particles in said coating is from 5 to 30 $mg/cm^2$.

7. A fused silica envelope as in claim 1 wherein the weight of $B_2O_3$ in said adhesion layer is about 0.1 $mg/cm^2$ and that of colloidal $Al_2O_3$ is about 0.3 $mg/cm^2$, and the weight of $Al_2O_3$ particles in said coating is from 5 to 30 $mg/cm^2$.

8. A fused silica envelope having an optically reflective coating of $ZrO_2$ particles adherent thereto by means of an adhesion layer consisting of colloidal aluminum oxide and boric oxide heat-reacted with the silica surface, said $ZrO_2$ particles being heat-reacted with said adhesion layer, the aluminum oxide and boric oxide being dispersed between the $ZrO_2$ particles.

9. A fused silica envelope as in claim 8 wherein the aluminum oxide and boric oxide are also present in a layer intermediate the silica surface and the $ZrO_2$ particles.

10. An alumina ceramic envelope having an optically reflective coating of refractory metal oxide particles adherent thereby by means of an adhesion layer consisting of colloidal aluminum oxide and boric oxide heat-reacted with the particles and the alumina surface.

* * * * *